US008100741B2

(12) United States Patent
Gustafsson et al.

(10) Patent No.: US 8,100,741 B2
(45) Date of Patent: Jan. 24, 2012

(54) VIBRATION DEVICE FOR A SUPER FINISHING APPARATUS AND AN ATTACHMENT TOOL COMPRISING THE VIBRATION DEVICE

(75) Inventors: Martin Gustafsson, Göteborg (SE); Paul Shore, Bedfordshire (GB)

(73) Assignee: Aktiebolaget SKF, Gothenburg (SE)

( * ) Notice: Subject to any disclaimer, the term of this patent is extended or adjusted under 35 U.S.C. 154(b) by 460 days.

(21) Appl. No.: 12/158,556

(22) PCT Filed: Dec. 21, 2006

(86) PCT No.: PCT/SE2006/001474

§ 371 (c)(1),
(2), (4) Date: Jun. 20, 2008

(87) PCT Pub. No.: WO2007/073309

PCT Pub. Date: Jun. 28, 2007

(65) Prior Publication Data

US 2008/0318498 A1 Dec. 25, 2008

(51) Int. Cl.
*B24B 49/00* (2006.01)

(52) U.S. Cl. ..... 451/11; 451/162; 451/164; 451/165

(58) Field of Classification Search ..... 451/11, 451/162, 164, 165

See application file for complete search history.

(56) References Cited

U.S. PATENT DOCUMENTS

| | | | | |
|---|---|---|---|---|
| 2,238,646 | A * | 4/1941 | Indge | 451/164 |
| 2,606,410 | A | 8/1952 | Thery | |
| 3,089,289 | A | 5/1963 | Serafin | |
| 3,393,477 | A * | 7/1968 | Ahlstrom | 451/415 |
| 3,457,680 | A * | 7/1969 | Gisaburo | 451/164 |
| 4,546,575 | A * | 10/1985 | Adams | 451/24 |
| 4,686,794 | A * | 8/1987 | Weber et al. | 451/164 |
| 4,800,682 | A | 1/1989 | Wolters et al. | |
| 6,086,255 | A | 7/2000 | Lyon | |
| 6,872,124 | B2 * | 3/2005 | Matsuzaki et al. | 451/13 |
| 2002/0152616 | A1 | 10/2002 | Ozaki et al. | |

(Continued)

FOREIGN PATENT DOCUMENTS

| | | |
|---|---|---|
| DE | 2 326 690 | 12/1974 |

(Continued)

OTHER PUBLICATIONS

European Search Report issued in corres. EP 05 11 2775, Sep. 19, 2006, EPO, Munich, DE.

(Continued)

*Primary Examiner* — Maurina Rachuba

(74) *Attorney, Agent, or Firm* — Buchanan, Ingersoll & Rooney PC

(57) ABSTRACT

A vibration device for a super finishing apparatus for super finishing a mechanical object is disclosed. It comprises at least two sliding means (1, 3), each comprising a guide (5, 7) and an element (9, 11) provided with a through hole (13) for receiving the guide (5, 7), allowing a relative movement between the guide (5, 7) and the element (9, 11) provided with the through hole (13), and a movable structure (15) fixed to the at least two sliding means (1, 3). Further, each sliding means (1, 3) presents at least one liquid fluid inlet (19) allowing a liquid fluid to enter the through hole (13) and suspend the guide (5, 7) in relation to an inner surface of the through hole (13). An attachment tool comprising the vibration device is also disclosed.

19 Claims, 4 Drawing Sheets

U.S. PATENT DOCUMENTS

| | | | | |
|---|---|---|---|---|
| 2004/0042689 | A1 | 3/2004 | Wasson et al. | |
| 2004/0137830 | A1 * | 7/2004 | Ohnishi | 451/41 |

FOREIGN PATENT DOCUMENTS

| | | | |
|---|---|---|---|
| DE | 29 24 324 | A1 | 1/1980 |
| DE | 30 07 314 | A1 | 9/1981 |
| DE | 36 33 531 | C11 | 8/1987 |
| EP | 0 553 526 | A1 | 8/1993 |
| EP | 1 147 851 | A1 | 10/2001 |
| EP | 1 231 392 | A1 | 8/2002 |
| EP | 1 502 702 | A2 | 2/2005 |
| EP | 1 506 838 | A1 | 2/2005 |

OTHER PUBLICATIONS

International Search Reporl and Written Opinion of the International Search Authority.

* cited by examiner

VIBRATION DEVICE FOR A SUPER FINISHING APPARATUS AND AN ATTACHMENT TOOL COMPRISING THE VIBRATION DEVICE

TECHNICAL FIELD

According to a first aspect, the present invention relates to a vibration device for a super finishing apparatus for super finishing a mechanical object.

According to a second aspect, the present invention relates to an attachment tool in a machining device comprising a device according to the first aspect.

BACKGROUND OF INVENTION

In U.S. Pat. No. 3,457,680, a grind stone head vibrating device for a superfinishing machine is disclosed. It presents right and left vibrators supporting the stone heads mounted on at least one pair of upper and lower round rods through bearings suspended by air. An oscillation ring is rotatably mounted and is provided with a pair of eccentric cams arranged to be equally eccentric in the opposite directions at the side of the right and left vibrators. The right and left hand vibrators are retained movably back and forth by springs pressing the vibrators towards the cams.

In U.S. Pat. No. 6,872,124, a superfinishing apparatus is disclosed. It includes a frame holding the entirety of the apparatus, a cam shaft attached to the frame so as to rotate freely, first and second eccentric cams which are attached to the cam shaft and rotate with a phase difference of 180 degrees therebetween, a first vibrator having a polygonal shape in its section which moves in a sliding manner in accordance with the rotation of the first eccentric cam, a second vibrator having a polygonal shape in its section which is disposed so as to oppose to the first vibrator through the cam shaft and moves in a sliding manner in accordance with the rotation of the second eccentric cam, bearings suspended by air for supporting the first vibrator and the second vibrator, and a superfinishing stone attached to the first vibrator or the second vibrator.

A limitation of the vibrating devices briefly described above is that the forces exerted on a mechanical object being superfinished by the grind stone head vibrating device is relatively low and accordingly limited to small mechanical objects. The load capacity of an air suspended vibrator is relatively low and prevents a compact design when higher exerted forces are needed. A compact design is a key requirement according to the second aspect of the invention. This leads to a low maximum force that may be exerted on the mechanical object to be finished via the stone. A too high force exerted on the mechanical object leads to a significantly decreased functionality of the bearings suspended by air.

Another limitation is the need of having two vibrators. This leads to overly complex and expensive vibrating devices.

SUMMARY OF INVENTION

According to the first aspect, a vibration device for a super finishing apparatus for super finishing a mechanical object is disclosed. Super finishing in view of this invention is considered to also include honing, i.e. a material removal process. It comprises at least two sliding means, each comprising a guide and an element provided with a through hole for receiving the guide, allowing a relative movement between the guide and the element provided with the through hole. The movable structure is fixed to the at least two sliding means.

Each sliding means presents at least one liquid fluid inlet allowing a liquid fluid to enter the through hole and suspend the guide in relation to an inner surface of the through hole of the element. A purpose of the liquid fluid is to decrease the friction between the surfaces of the through hole and the guide. Using a liquid fluid inlet and a liquid fluid leads to an increased opportunity of suspending the guide in relation to an inner surface of the through hole. Thus, the present invention is of use both for small and large mechanical objects.

In an embodiment, there are at least three sliding means to support the movable structure. This leads to the advantage that it is possible for the vibration device to have a more compact design, which makes it also suitable for use in a machining device incorporating an automatic tool change. This also leads to an opportunity of the vibration device to carry a heavier load. Alternatively, this also makes it possible to have larger abrasive stone/larger work pieces.

In an embodiment, the vibration device is made of corrosion resistant material making it possible to use water as liquid fluid. This further leads to the advantage that, when the vibration device is incorporated in a machining device as an automatic tool, a higher flexibility is reached in terms of with what liquid fluid that such a machining device operates.

In an embodiment, the vibration device further comprises means for accomplishing a movement of the vibration device in relation to the work piece, leading to a pressure, in a normal direction in relation to the surface of the work piece. In an embodiment, the means is a pressure cylinder, supported by a slideway, offering the opportunity of controlling a position and/or movement in the normal direction. This leads to the advantage that the vibration device is even more suitable to be incorporated in a machining device. Also, this leads to the advantage of having operating settings defined in relation to an individual work piece, or types of work pieces, e.g. in terms of size of work pieces. The operation of the pressure cylinder is controlled by the machining device control systems.

Having a plurality of elements on each guide and a plurality of guides leads to an opportunity of applying a stronger force on the abrasive stone receiving portion leading to an opportunity of applying a stronger force on the abrasive stone when super finishing. Also, this offers an ability to allow a higher bending torque caused by the stronger force on the abrasive stone receiving portion.

In another embodiment, a sealing means for maintaining the liquid fluid in the space between the guide and the inner surface of the through hole is provided. The sealing means seals the space along the axial direction between the inner surface of the through hole and the guide. The sealing means may be constituted by a plurality of seals, e.g. by sealing at two axial locations for each sliding means and thereby accomplishing a compartment, which is closed. One of the advantages offered is that a higher force may be exerted on the mechanical object to be finished. Also a larger stone may be used. This leads to shorter time to accomplish a desired superfinishing result. This is a result from using a liquid fluid to suspend the guides from the inner surfaces of the through holes. Also, using a single vibrator is sufficient to accommodate a preferred superfinishing of the mechanical object. This leads to a more compact vibration device. The mechanical object presents a flat characteristic, such as a flat surface, or concave or convex characteristic, such as a surface of a ring.

In an embodiment, the movable structure further comprises an abrasive stone receiving portion.

In an embodiment, the at least two guides and the abrasive stone, when arranged on the receiving portion, are in the same plane. This leads to a lower bending torque on the guides. This also leads to a more compact design.

In an embodiment, the at least two guides and the abrasive stone, when arranged on the stone receiving portion, are in different planes.

In an embodiment, the device further comprises an eccenter for accomplishing a vibratory movement of the movable structure in relation to the support structure.

The eccenter presents a non symmetric feature that when engaging in the movable structure accomplishes a linearly oscillating motion.

In an embodiment, the device further comprises a filter for filtering the liquid fluid. The filter is responsive for filtering the liquid fluid.

In an embodiment, the liquid fluid comprises at least one of oil, water, and a processing fluid/machining fluid of a mechanical processing machine. This leads to an opportunity of offering an ever more compact device.

Also it is easier to mount. Also, it is cheaper to manufacture.

In an embodiment, the device further comprises an air/pneumatic motor for driving the vibration device. The operation of the air/pneumatic motor is controlled by the machining device control system. This leads to a more compact device.

In an embodiment, the device further comprises air supply connection means for connecting with an air providing connection of a mechanical processing machine.

This leads to the advantage that the device may be driven by standard equipment of mechanical processing machines.

In an embodiment, an inner surface of the through hole presents at least one pocket for receiving the liquid fluid. This leads to an opportunity of handling pressure variations in the space between the guides and the inner surfaces of the through holes comprising the liquid fluid.

In an embodiment, the mechanical object is a ring or a roller of a bearing.

In an embodiment, the at least one pressure restricting means is constituted by at least one canal extending through the element and between an inner surface of the through hole and an outside of the element.

According to the second aspect of the invention, an attachment tool in a machining device is disclosed. It comprises a device based on the first aspect. An advantage of this is that employing the device according to the first aspect in an existing machining device is simplified.

In an embodiment, the attachment tool is part of an automatic tool change.

In an embodiment, the attachment tool further presents means for attaching the attachment to the machining device.

In an embodiment, the machining device is a grinding machine or a turning machine.

DESCRIPTION OF PREFERRED EMBODIMENTS

Figure 1A:
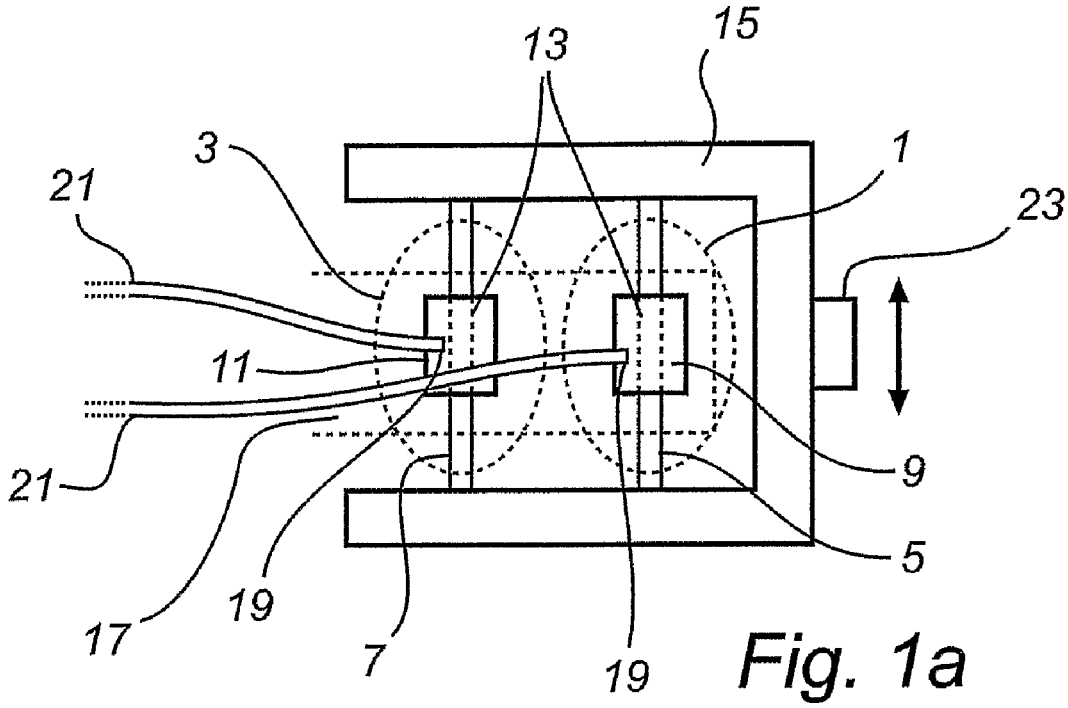
In FIGS. 1A and 1B, schematic embodiments of the device according to the first aspect are given.
Figure 1B:
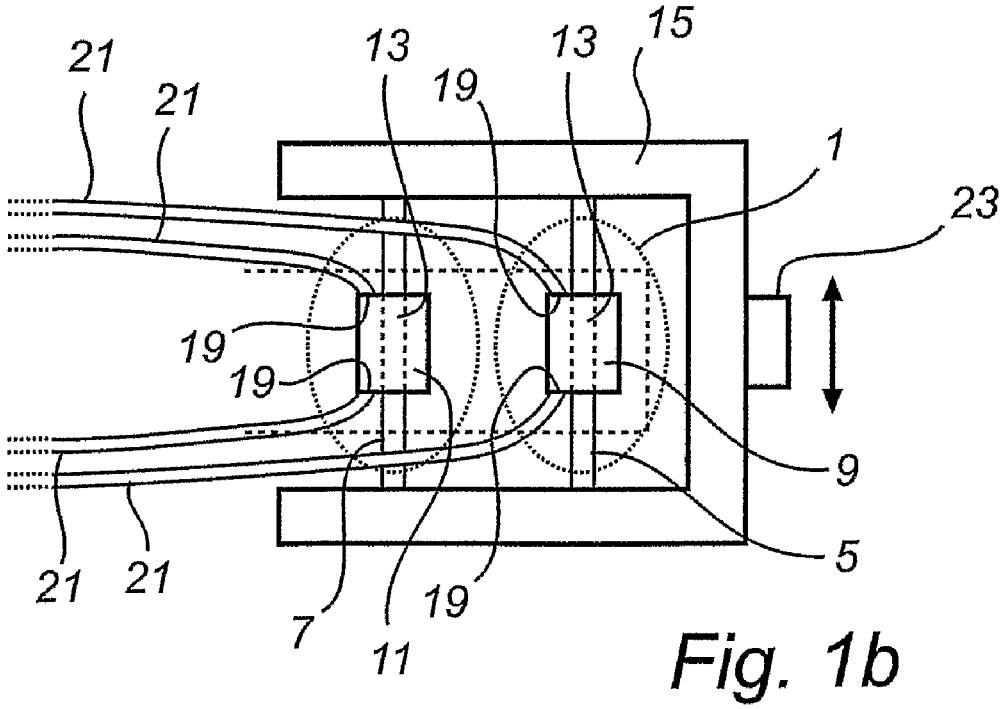

In FIG. 1A, a schematic embodiment of a vibration device for a super finishing apparatus for super finishing a mechanical object is disclosed. It comprises two sliding means 1, 3. Each sliding means 1, 3 comprises a guide 5, 7 and an element 9, 11 provided with a through hole 13 for receiving the guide 5, 7. This allows a relative movement between the guide 5, 7 and the element 9, 11 provided with the through hole 13. The arrow indicates the direction of the relative movement. A movable structure 15 is fixed to the at least two sliding means 1, 3. The sliding means 1, 3 may be fixed to a support structure 17, indicated in FIG. 1 by the dashed lines. The sliding means 1, 3 may be fixed to the support structure 17 by the element 9, 11 being fixed thereto allowing the guide 5, 7 to oscillate in the through hole 13. Alternatively, the guide 5, 7 is fixed to the support structure 17 and the element 9, 11 oscillates. Each sliding means 1, 3 presents at least one liquid fluid inlet 19 allowing a liquid fluid to enter the through hole 13 and suspend the guide 5, 7 in relation to an inner surface of the through hole 13. In an embodiment the at least one liquid fluid inlet 19, to which liquid fluid conduit 21 are attached, is located in the guide 5, 7. This is preferred in case the guide 5, 7 is still and the element 9, 11 oscillates. In another embodiment, the at least one liquid fluid inlet 19 is located in the element 9,11. This is preferred when the guide 5, 7 (and the movable structure 15) moves and the element 9,11 is still. In another embodiment, shown in FIG. 1B, also comprising two sliding means 1, 3 at least one liquid fluid inlet 19 is at an end of a liquid fluid conduit 21 that ends near the through hole in order to facilitate liquid fluid to be introduced to the space between an inner surface of the through hole 13 and an outer surface of the guide 5, 7 and thereby accomplishing a suspending effect. In FIG. 1B there is not only a single liquid fluid conduit 21 but a plurality of liquid fluid conduits 21, namely two liquid fluid conduits 21 for each element 1, 3. In embodiments of the device, the number of liquid fluid inlets 19, or liquid fluid conduits 21, may differ in relation to the number of sliding means 1, 3, e.g. one sliding means 1, 3 may have a single liquid fluid inlet 19, or a single liquid fluid conduit 21 and another may have two inlets 19, or conduits 21.

The movable structure 15 further comprises an abrasive stone-receiving portion 23, to which an abrasive stone is to be attached.

Figure 2A:
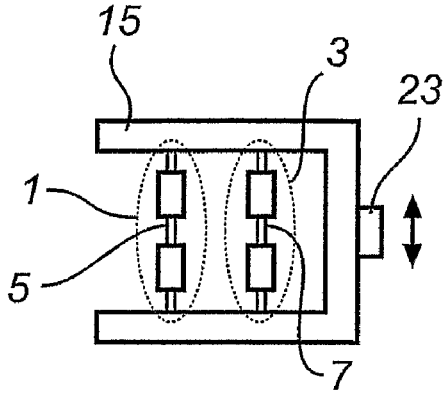
In FIGS. 2A, 2B, 2C, and 2D further schematic embodiments of the device according to the first aspect are given.
Figure 2B:
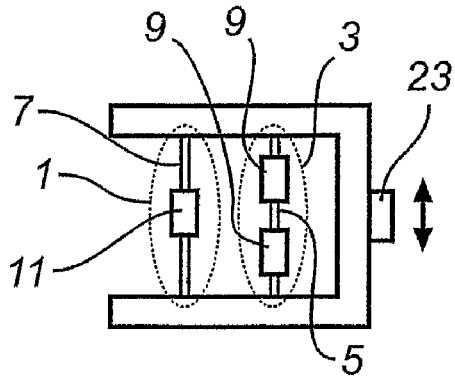
Figure 2C:
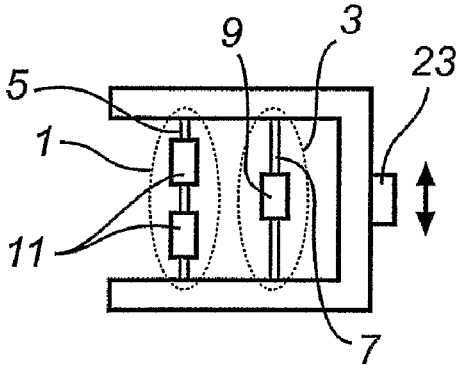
Figure 2D:
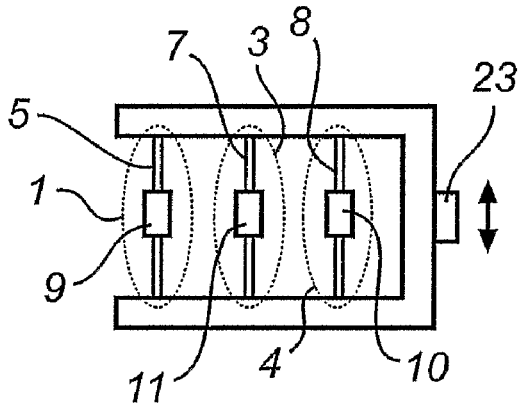

In FIGS. 2A to 2D, embodiments of arrangements of sliding means 1, 3 and the movable structure 15 are given. In FIG. 2A, an embodiment comprising two sliding means 1, 3 comprising four elements 9, 11 and two guides 5, 7 is given. Each guide 5, 7 has two elements 9, 11. In FIG. 2B, an embodiment comprising two sliding means 1, 3 in which a guide 5 near the stone receiving portion 23 present two elements 9 and the guide 7 more distant from the stone receiving portion 23 presents a single element 11. In FIG. 2C, an embodiment comprising two sliding means 1, 3 in which a guide 7 near the stone receiving portion 23 present an element 9 and the guide 5 more distant from the stone receiving portion 23 presents two elements 11. In FIG. 2D, an embodiment comprising three sliding means 1, 3, 4 in which there are three guides 5, 7, 8 located at different distances from the stone receiving portion 23. Each guide 5, 7, 8 presents an element, 9, 10, 11. In FIG. 2D, the guides 5, 7, 8 are in the same plane, also potentially in the same plane as the abrasive stone receiving portion 23, for reasons of compactness. However, in an alternative embodiment, the guides 5, 7, 8 are not in the same plane.

Figure 3A:
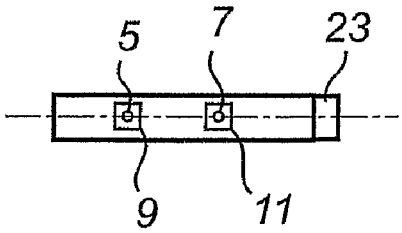
In FIGS. 3A and 3B, the device according to the first embodiment is shown from a side in relation to the embodiments given in FIGS. 1A, 1B, 2A-2D.
Figure 3B:
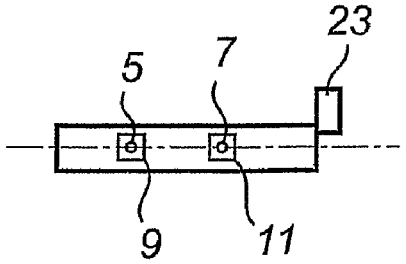

In an embodiment, the at least two guides 5, 7 and the abrasive stone, when arranged on the receiving portion 23, are in the same plane, as indicated in FIG. 3A. In an alternative embodiment shown in FIG. 3B, the at least two guides 5, 7 and the abrasive stone, when arranged on the stone receiving portion 23, are in different planes.

Figure 4:
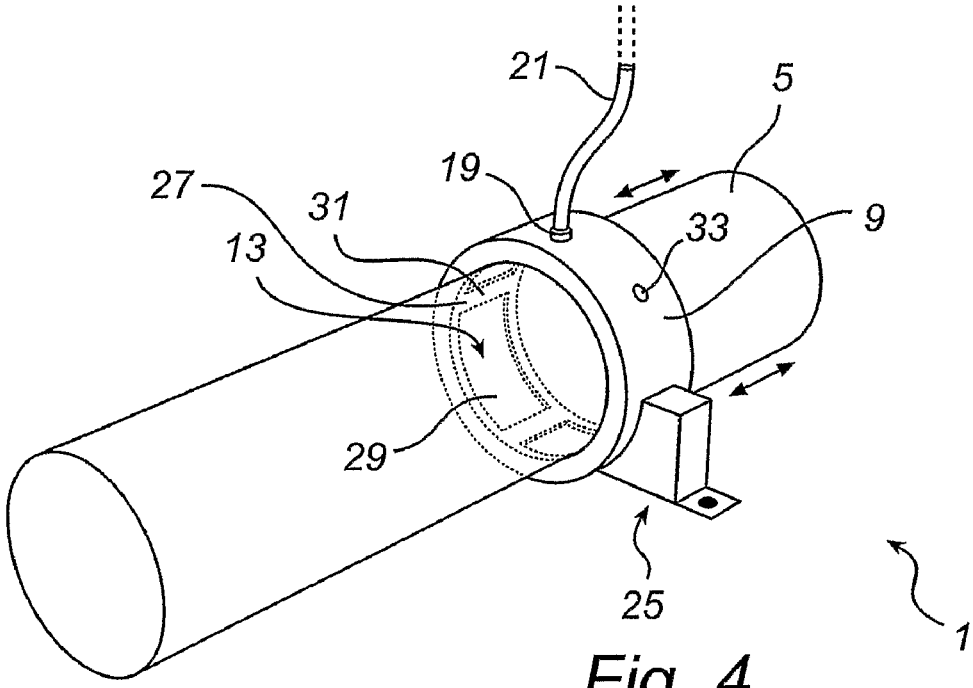
In FIG. 4, a schematic embodiment of one of the elements through which a guide oscillates is given.

In FIG. 4, an embodiment of sliding means 1 is given. An element 9 is shown and a guide 5 is indicated using a dashed line. The arrows indicate the direction of the movement between the element 9 and the guide 5. One of the element 9 and the guide 5 is fixed to the support structure and the other is fixed to the movable structure. In the embodiment given in FIG. 4, the element 9 presents a fixing means 25.

In an embodiment, the inner surface 27 of the through hole 13 of the element 9 presents at least one pocket 29 for receiving the liquid fluid. In an embodiment, the pocket 29 extends along the circumference of the inner surface 27. Alternatively, there may be a plurality of pockets 29 separated by pocket limiting means 31. In an embodiment, pressure restricting means 33, constituted by at least one canal, extending between an inner surface 27 of the through hole 13 and an outside of the element 9. This offers an opportunity for liquid fluid to pass through and thereby decrease the pressure of the liquid fluid located between the inner surface 27 and the surface of the guide 5, and in the pocket(s) 29.

In an embodiment, a liquid fluid inlet 19 is located through the element 9 and associated thereto is a liquid fluid conduit 21 for providing liquid fluid to the inlet 21 and for accommodating a suspending relation between the guide 5 and the element 9.

Figure 5:
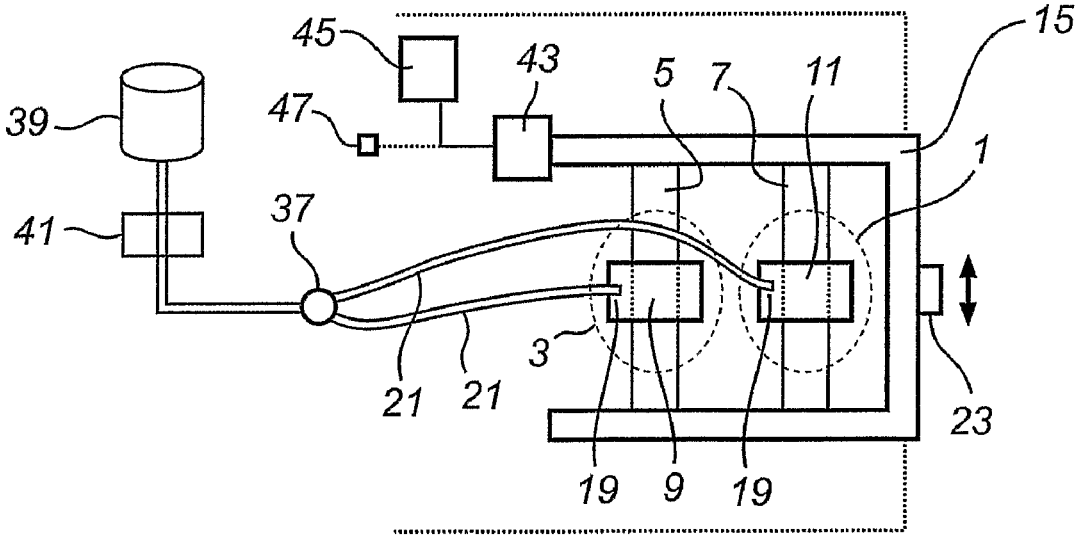
In FIG. 5, a schematic embodiment of the device including a few additional features according to the first aspect is given.

In FIG. 5, an embodiment is given. It comprises two sliding means 1, 3 comprising two guides 5, 7 and two elements 9, 11. The elements 9, 11 are fixed to the support structure 17 and the guides 5, 7 are fixed to the movable structure 15. Liquid fluid conduits 21 provide liquid fluid to liquid fluid inlets 21 of the elements 9, 11. Also, a pump 37 for facilitating a pressurized liquid fluid is given as well as a liquid fluid container 39. A filter 41 is shown as located between the liquid fluid container 39 and the liquid fluid pump 37. It should be pointed out that the filter 41 may be located upstream the liquid fluid container 39, i.e. the contents of the liquid fluid container 39 have already been filtered.

Alternatively the filter 39 may be located downstream the pump 37, i.e. the liquid fluid is filtered just before being introduced to the sliding means 1, 3. The device further comprises an eccenter 43 for accomplishing a vibratory movement of the movable structure 15 in relation to a support structure 17. The eccenter 43 is powered by a designated motor 45 or a motor of a machining device in relation to which the device is intended to be used. An example of a designated motor is an air/pneumatic motor. Alternatively, the device further comprises air supply connection means 47 for connecting with an air providing connection of a mechanical processing machine (not shown).

In an embodiment, the liquid fluid is one of oil, water, and the processing liquid fluid or machining fluid of a mechanical processing machine.

In an embodiment, the mechanical object is a ring or a roller of a bearing.

Figure 6:
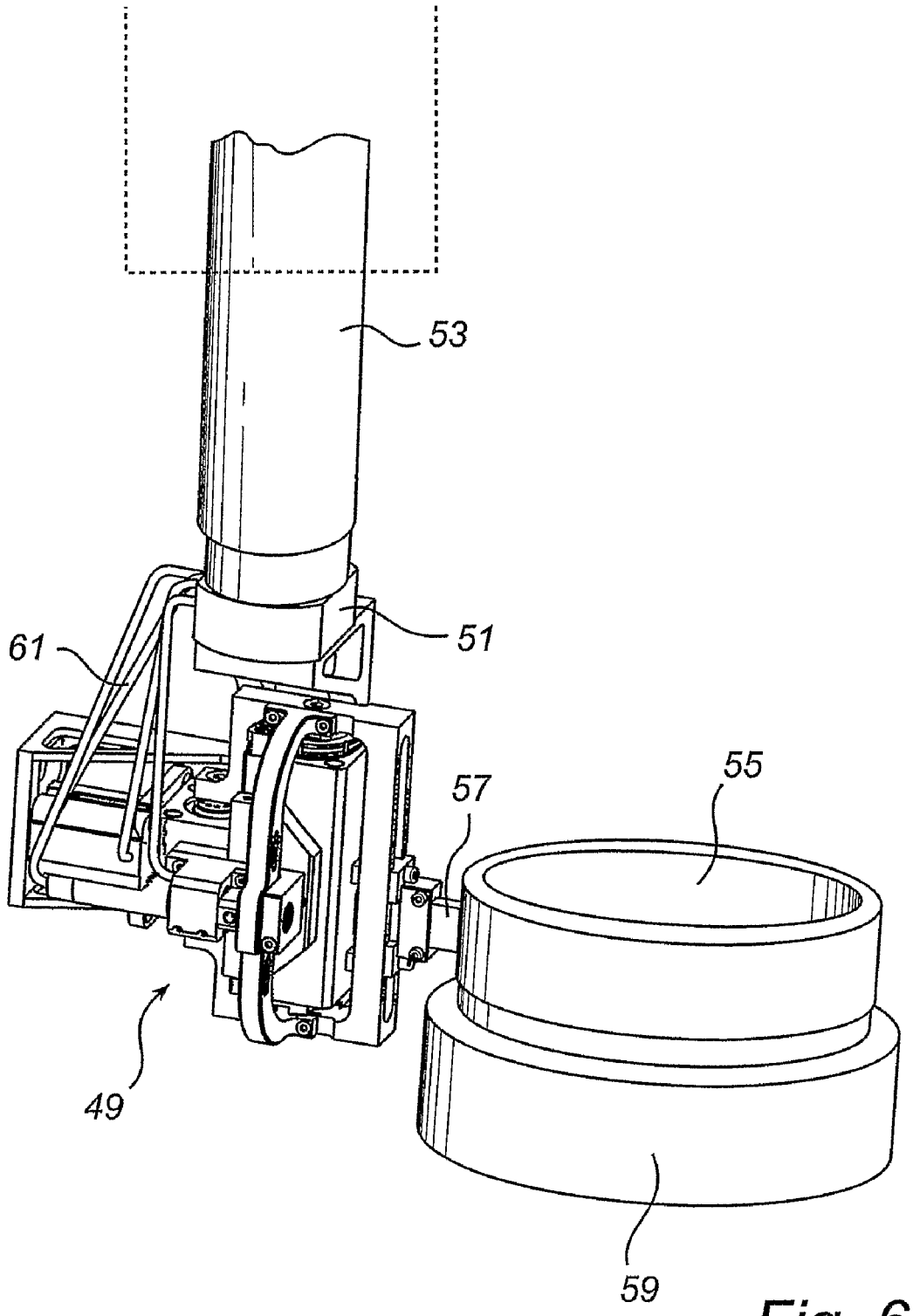
In FIG. 6, a schematic embodiment of an attachment tool according to the second aspect is given.

In FIG. 6, an attachment tool 49 in a machining device (not shown) comprising the device is disclosed.

The attachment tool 49 further presents means for attaching the attachment to the machining device, e.g. a holder for automatic tool change 51 arranged on a machine tool axis 53. For supporting the superfinishing of a mechanical object 55, using an abrasive stone 57, arranged on a work head 59, a media supply means 61 is also provided. In an embodiment, the machining device is a grinding machine or a turning machine.

The invention claimed is:

1. The combination of a machining device, a vibration device, and an attachment tool, the vibration device comprising:

a first guide;

a second guide;

a first element possessing a through hole and mounted on the first guide so that the first guide passes through the through hole, the first element being movable relative to and along the first guide;

a second element possessing a through hole and mounted on the second guide so that the second guide passes through the through hole of the second element, the second element being movable relative to and along the second guide;

a movable structure to which is fixed the first and second guides;

an abrasive stone mounted on the movable structure to move together with the movable structure;

the first element comprising a first liquid fluid inlet opening to the through hole of the first element to allow a liquid fluid to enter the through hole of the first element and suspend the first guide in relation to an inner surface of the through hole of the first element; and the second element comprising a second liquid fluid inlet opening to the through hole of the second element to allow a liquid fluid to enter the through hole of the second element and suspend the second guide in relation to an inner surface of the through hole of the second element; and the attachment tool connecting the vibration device to the machining device, the attachment tool comprising an automatic tool change.

2. The combination according to claim 1, wherein the movable structure further comprises an abrasive stone receiving portion for receiving an abrasive stone.

3. The combination according to claim 2, wherein the at least two guides and the abrasive stone, when arranged on the receiving portion, are in the same plane.

4. The combination according to claim 2, wherein the at least two guides and the abrasive stone, when arranged on the stone receiving portion, are in different planes.

5. The combination according to claim 1, further comprising an eccenter for accomplishing a vibratory movement of the movable structure in relation to a support structure.

6. The combination according to claim 1, further comprising a filter for filtering the liquid fluid.

7. The combination according to claim 1, wherein the liquid fluid is one of oil, water, and processing liquid fluid or machining fluid of a mechanical processing machine.

8. The combination according to claim 1, further comprising an air/pneumatic motor for driving the vibration device.

9. The combination according to claim 8, further comprising air supply connection means for connecting with an air providing connection of a mechanical processing machine.

10. The combination according to claim 1, wherein the inner surface of the through hole presents at least one pocket for receiving the liquid fluid.

11. The combination according to claim 1, wherein the mechanical object is a ring or a roller of a bearing.

12. The combination according to claim 1, further comprising at least one pressure restricting means constituted by at least one canal extending between an inner surface of the through hole of the first element and an outside of the first element.

13. The combination according to claim 1, further presenting means for attaching the attachment tool to the machining device.

14. A vibration device for a super finishing apparatus for super finishing a mechanical object, comprising:

a first guide;

a second guide;

a first element possessing a through hole and mounted on the first guide so that the first guide passes through the through hole, the first element being movable relative to and along the first guide;

a second element possessing a through hole and mounted on the second guide so that the second guide passes through the through hole of the second element, the second element being movable relative to and along the second guide;

a movable structure comprising a first guide mount, a second guide mount, and an abrasive stone mount connecting the first guide mount and the second guide mount so that the first guide mount, the second guide mount, and the abrasive stone mount move together, at least one of the first guide and the second guide extending between and being connected to both the first guide mount and the second guide mount;

an abrasive stone mounted on the abrasive stone mount so that the abrasive stone moves together with the movable structure;

the first element comprising a first liquid fluid inlet opening to the through hole of the first element to allow a liquid fluid to enter the through hole of the first element and suspend the first guide in relation to an inner surface of the through hole of the first element; and the second element comprising a second liquid fluid inlet opening to the through hole of the second element to allow a liquid fluid to enter the through hole of the second element and suspend the second guide in relation to an inner surface of the through hole of the second element.

15. Device according to claim 14, wherein the inner surface of the through hole of both the first and second elements is provided with a pocket for receiving the liquid fluid.

16. Device according to claim 14, wherein the first liquid fluid inlet and the second liquid fluid inlet are connected to a container containing the liquid fluid.

17. Device according to claim 14, wherein the first liquid fluid inlet is connected to first tubing adapted to be connected to a container containing the liquid fluid and the second liquid fluid inlet is connected to second tubing adapted to be connected to the container containing the liquid fluid.

18. Device according to claim 14, further comprising an eccenter connected to a motor, the eccenter being connected to the movable structure to vibrate the movable structure.

19. The combination according to claim 1, wherein the machining device is a grinding machine or a turning machine.

* * * * *